US007357130B2

(12) United States Patent
Broersma

(10) Patent No.: US 7,357,130 B2
(45) Date of Patent: Apr. 15, 2008

(54) SPRING-ASSISTED PAINTBALL LOADER

(75) Inventor: Lester Broersma, San Diego, CA (US)

(73) Assignee: JT USA, LLC, Bentonville, AR (US)

( * ) Notice: Subject to any disclaimer, the term of this patent is extended or adjusted under 35 U.S.C. 154(b) by 330 days.

(21) Appl. No.: 11/123,650

(22) Filed: May 5, 2005

(65) Prior Publication Data

US 2006/0249131 A1 Nov. 9, 2006

(51) Int. Cl.
*F41B 11/02* (2006.01)

(52) U.S. Cl. ..... 124/51.1; 124/52

(58) Field of Classification Search ..... 124/45, 124/48, 49, 51.1, 52
See application file for complete search history.

(56) References Cited

U.S. PATENT DOCUMENTS 5,954,042 A * 9/1999 Harvey ..... 124/51.1
6,213,110 B1 * 4/2001 Christopher et al. ..... 124/51.1
6,327,953 B1 * 12/2001 Andresen ..... 89/33.17
6,502,567 B1 * 1/2003 Christopher et al. ..... 124/51.1
6,701,907 B2 * 3/2004 Christopher et al. ..... 124/48
6,889,680 B2 * 5/2005 Christopher et al. ..... 124/51.1

* cited by examiner

*Primary Examiner*—John A. Ricci
(74) *Attorney, Agent, or Firm*—Keisling Pieper & Scott PLC; David B. Pieper; Trent C. Keisling

(57) ABSTRACT

A mechanism for feeding uniformly-sized spherical projectiles such as paintballs into a gun adapted to shoot said projectiles is positioned in a lower region of a paintball-holding magazine, and includes a spinning body in the form of a spool from the peripheral side of which project radial arms shaped and dimensioned to urge projectiles toward a duct leading to the ammunition intake port of the gun. The spool is driven by a switchable electrical motor. In order to avoid gaps into the row of paintballs that are urged toward the ammunition intake port when the motor is not running which could result in dry firing, a resiliently variable linkage between the propelling arms is provided by a spiral spring or a pair of stretchable coil springs.

4 Claims, 4 Drawing Sheets

SPRING-ASSISTED PAINTBALL LOADER

FIELD OF THE INVENTION

This invention relates to ammunition feeding mechanisms and more specifically to mechanisms for feeding uniformly-sized spherical projectiles such as paintballs into a gun.

BACKGROUND OF THE INVENTION

The firing rate of most recent versions of paintball markers (also called paintball gun) sometimes exceeds the rate at which projectiles can be fed into the breech intake port. Accordingly, when feeding paintballs from a hopper or magazine, it is critical not to allow any delay or gap in the chain of projectiles moving toward the intake port of the marker. When the mechanism that propels the paintball toward the shoot or tube leading to the gun intake is started with each pull of the trigger then allowed to stop after a short period, the queue of paintballs may be disrupted when the propelling mechanism stops for lack of feeding pressure behind the last ball in the queue. Delays and gaps can thus be created, eventually causing dry firing of the gun.

The present invention results from attempts to avoid any interruption in the steady feeding of projectiles.

SUMMARY OF THE INVENTION

The principal and secondary objects of this invention are to assure a steady flow of projectiles into the intake port of a paintball marker, and avoiding dry firing due to gaps in the chain or row of projectiles being dispensed from a hopper or magazine.

This and other valuable objects are achieved by regulating the feeding of the paintballs to the gun and by maintaining an uninterrupted queue or row of projectiles in line toward the gun intake port According to the invention, a paddle-wheel consisting of at least one propelling arm projecting radially from a spinning body in the middle of a circular well located in the lowest region of the projectile magazine or loader is always pushing against the row of paintballs. An exit port in the wall of the well is connected to the gun ammunition intake by a chute or duct. The spinning body is momentarily driven by an electrical motor, and includes a resiliently variable linkage in the form of a spiral spring that remains under partial tension when the motor is de-energized, thus, applying enough pressure through the arm against the row of projectiles being fed to the gun to prevent gaps in the row of the projectiles progressing through the duct.

DESCRIPTION OF THE PREFERRED EMBODIMENTS OF THE INVENTION

Figure 1:
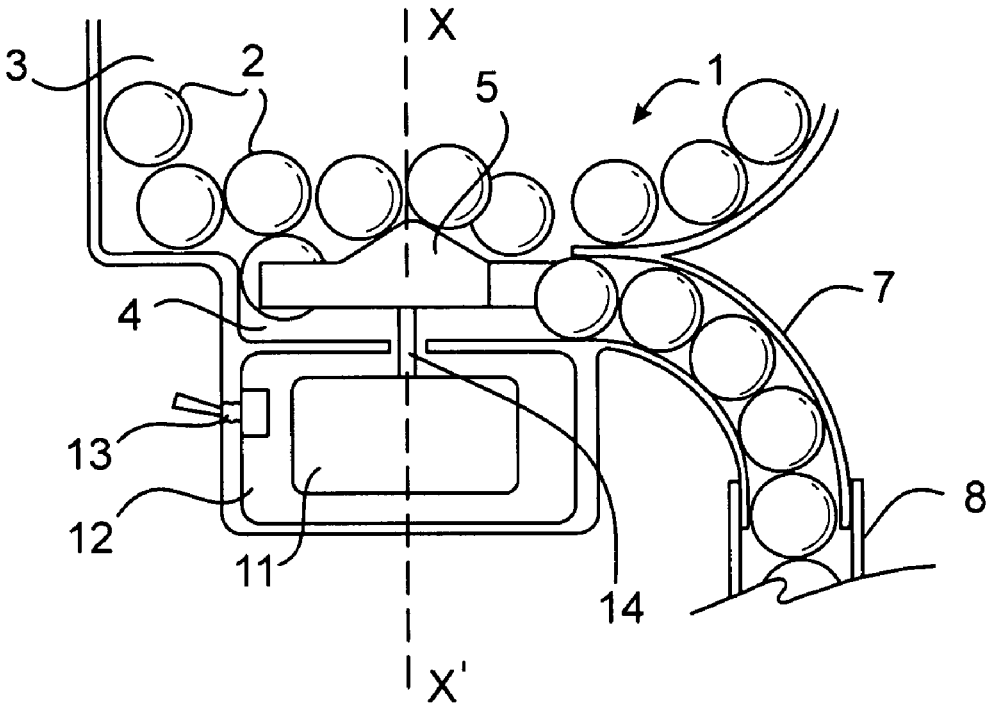
FIG. 1 is a diametrical cross-sectional view of the feeding mechanism according to the invention.
Figure 2:
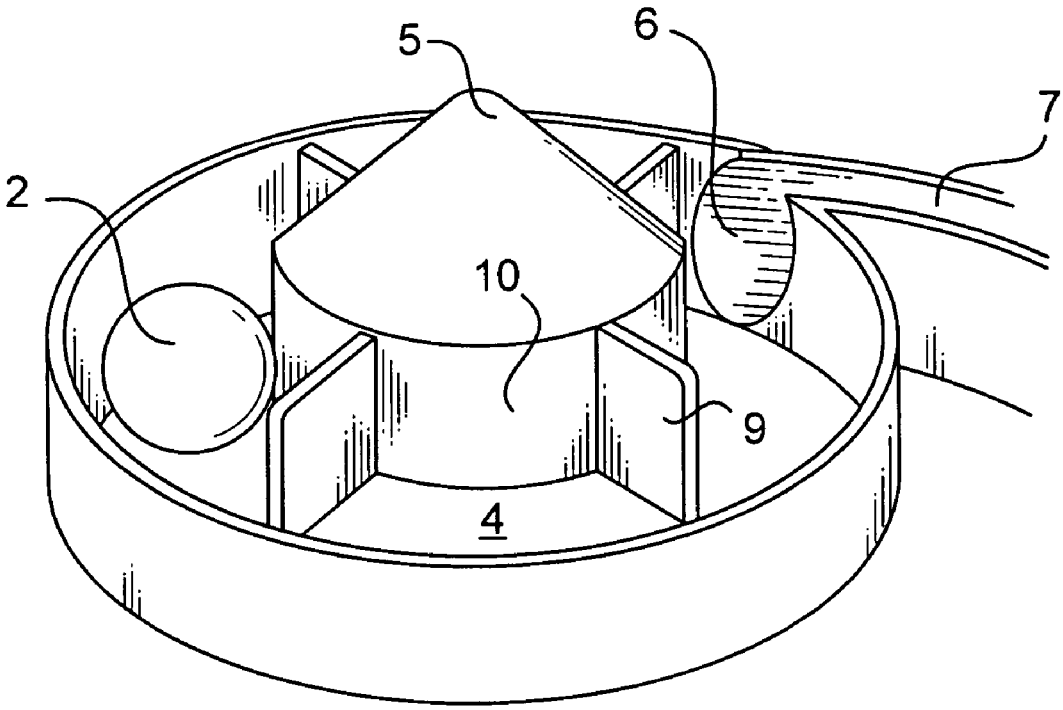
FIG. 2 is a perspective view of the spool and impelling arms in action.

Referring now to the drawing, there is shown in FIGS. 1-4 a first embodiment 1 of a paintball feeding mechanism according to the invention.

As paintballs 2 held in the magazine 3 drop into a well 4 in a lower region of the magazine, they are contacted by a spinning body in the form of a spool 5 and directed toward the inlet 6 of a duct 7 leading to the ammunition intake port 8 of a paintball marker or gun. A series of vanes or paddles 9 projecting radially and outwardly from the peripheral, outer wall 10 of the spool act as impelling arms for the paintballs 2. An electrical motor 11 positioned in a housing 12 immediately under the magazine well 4 can be energized and started, then stopped by means of a toggle switch 13. Alternately, as commonly found in certain paintball markers, the start of the motor can be initialized by the trigger mechanism and automatically stopped after a short period of time, or upon release of the trigger. The axle 14 of the motor engages the spool, and causes it to spin about a substantially vertical axis X-X'.

Figure 3:
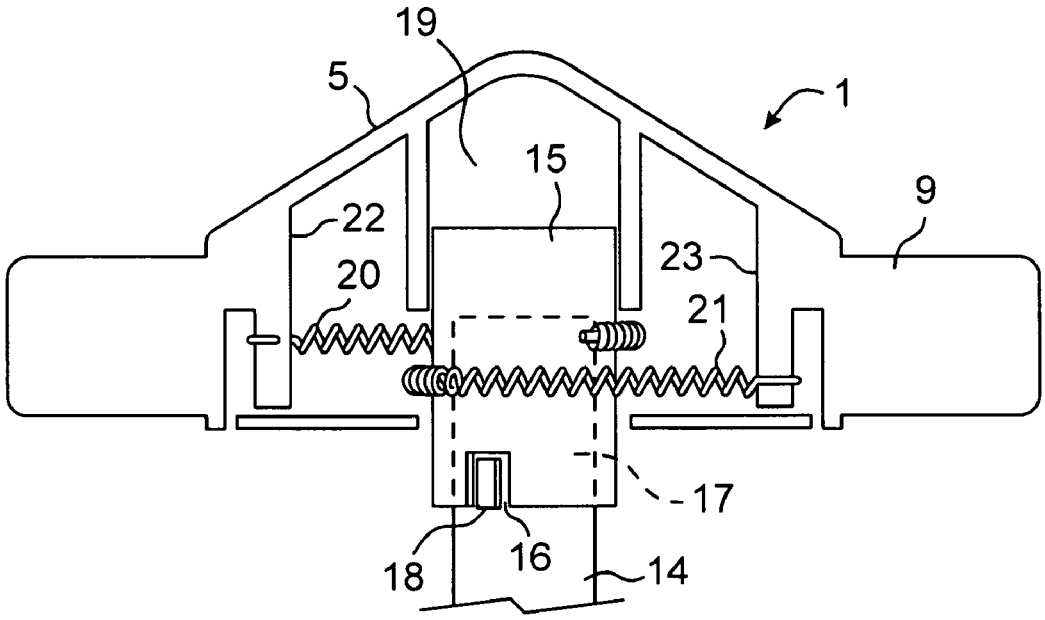
FIG. 3 is a cross-sectional view of the axle to spring assembly.
Figure 4:
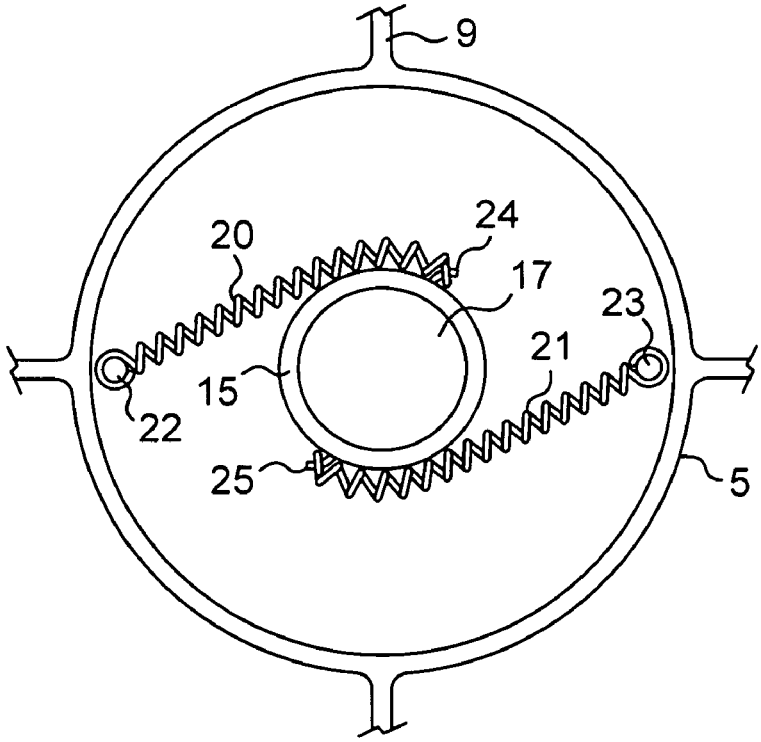
FIG. 4 is a bottom plan view of said assembly.

As more specifically illustrated in FIGS. 3 and 4, the coupling of the axle 14 to the spool 5 is accomplished to a resiliently variable mechanical assembly comprising a sleeve element 15 having a peripheral segmental opening or cut-out 16. A second element consisting of an end segment 17 of the motor axle is coaxially engaged into the sleeve element 15. A lug 18 projects radially from the axle element 17 into the opening 16.

The sleeve element 15 is rotationally journaled into a tubular housing 19 in the center top of the spool 5, and forms a central spool coaxial with and within the latter. A pair of stretchable coil springs 20, 21 provide the linkage between the sleeve element 15 and the spool. Each spring is first anchored at one end to a stud 22, 23 associated with the inner wall surface of the largest spool 5, and at the opposite end to a nib 24, 25 projecting outwardly and radially from the peripheral wall of the sleeve element 15. The anchoring of each spring is positioned 180 degrees from the anchoring of the other at their respective ends.

Figure 5:
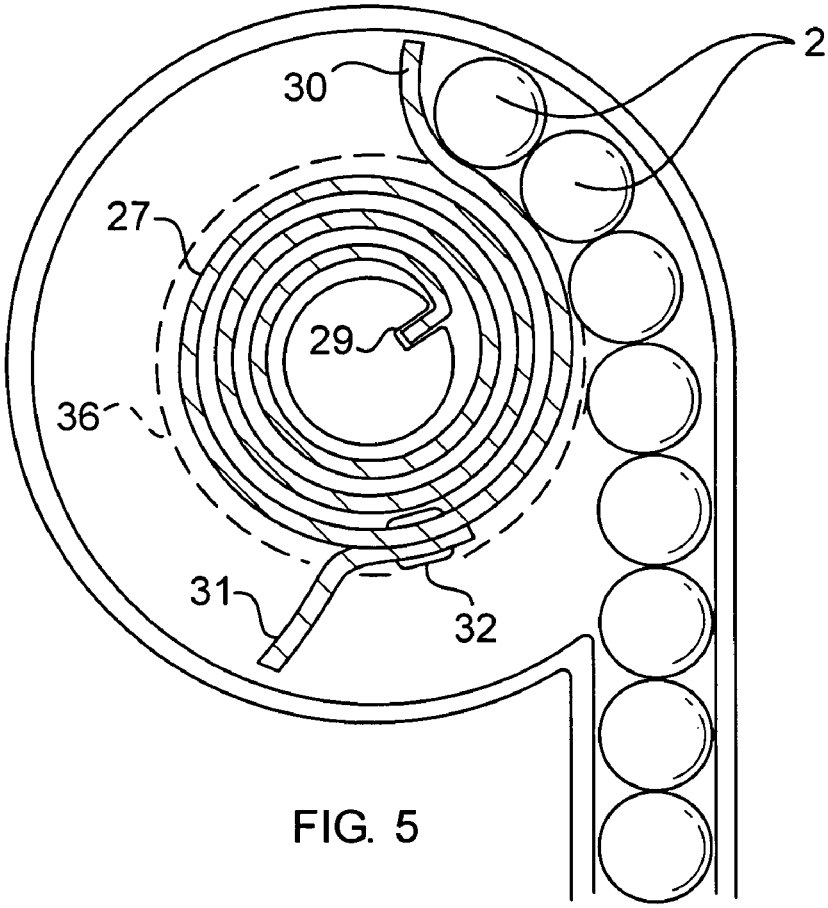
FIG. 5 is a top plan view of an alternate embodiment of the mechanism.
Figure 6:
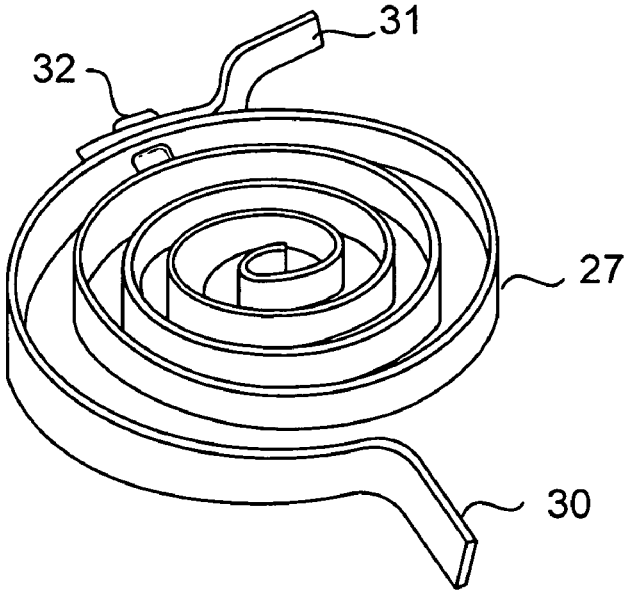
FIG. 6 is a perspective view of the spiral spring in FIG. 5.
Figure 7:
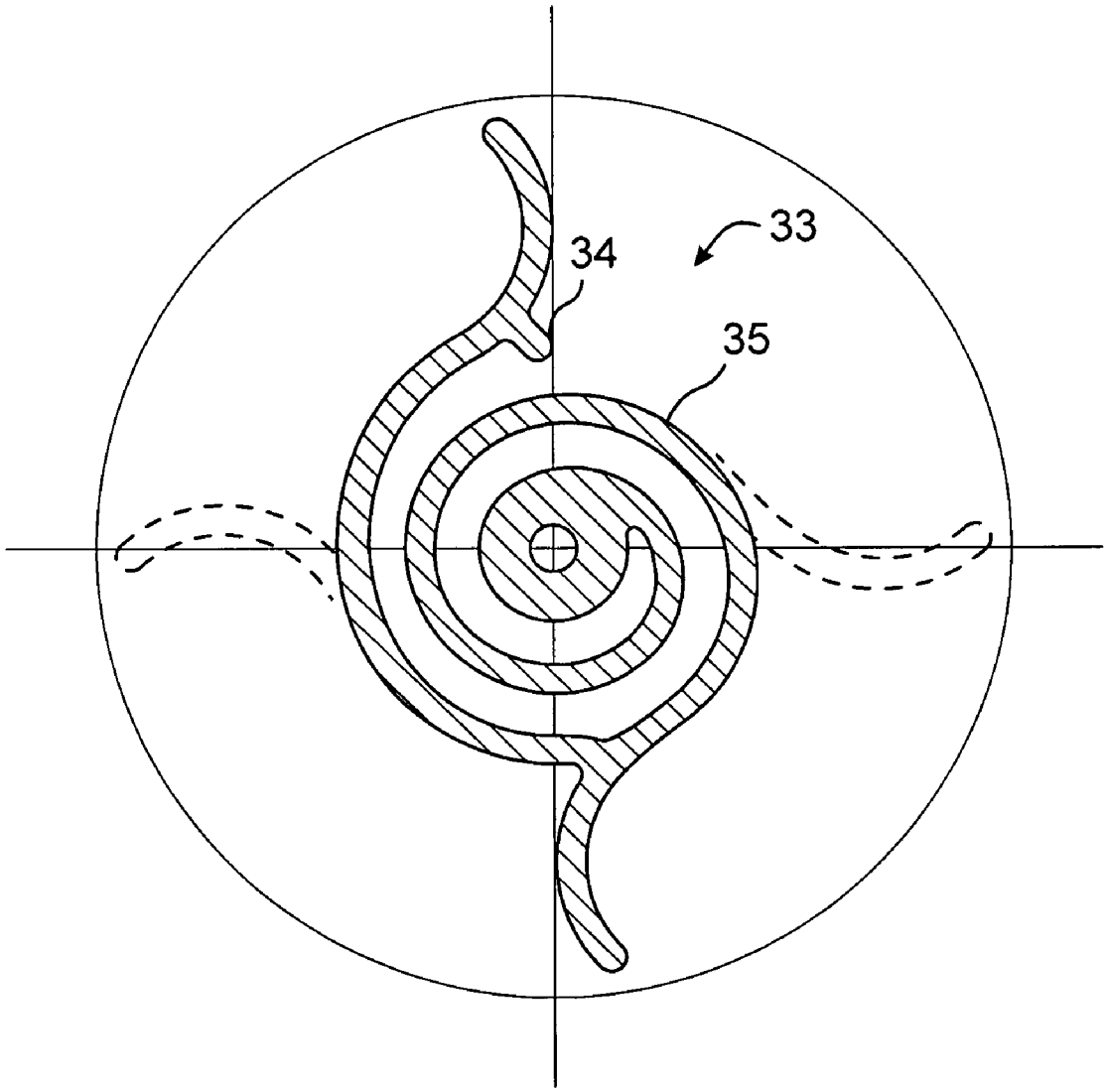
FIG. 7 is a top plan view of a molded plastic version of the spiral spring.

In the alternate embodiment 26 of the mechanism illustrated in FIGS. 5-7. The spool 5 and coil springs 20, 21 of the first described embodiment are replaced by a single spiral spring 27. The central and internal end portion 28 of the spring is captured by an axially slotted length 29 of the motor axle. This part of the axle corresponds to the spinning body of the previously described embodiment of the invention. The spiral spring 27 basically fulfill the same function as the aforesaid stretchable coil springs. The peripheral end portion 30 of the spiral spring is bent backward into a substantially radially projecting direction to act as a paddle and propelling arm for the paintballs 2. An additional propelling arm 31 is formed by shaping a separate strip of metal or a segment of a similar spiral spring in a shape symmetrical to that of the first arm 30 and attaching it to the spring by means of a rivet 32 in a location diametrically opposite to the first arm 30.

A molded plastic version 33 of the spiral spring of FIG. 6, is illustrated in FIG. 7. A nib 34, at the root of the arm formed by the peripheral end of the spring, comes to rest against the previous coil 35 when the spring is tightly wound and prevents that arm from bending too far backward when pushing against a row of paintballs.

A conical hub or cover 36 indicated by a dotted line on FIG. 5, not unlike the hub of the main spool 5 of FIG. 3, is mounted at the top end of the motor axle to cap the spiral spring.

While the preferred embodiments of the invention have been described, modifications can be made and other embodiments may be devised without departing from the spirit of the invention and the scope of the appended claims.

What is claimed is:

1. A mechanism for feeding spherical projectiles out of a holding magazine into the intake port of a gun, which comprises: a spinning body rotatably mounted in a lower region of said magazine about a substantially vertical axis; at least one impelling arm projecting outwardly and substantially radially from said body, said arm being positioned, shaped and dimensioned to contact and propel projectiles lying in said region toward said intake port; a motor having an axle coupled to said body; switching means for starting and stopping said motor; and means for regulating said feeding by maintaining an uninterrupted row of projectiles in line toward said intake port;

wherein said means for regulating includes a spiral spring having an internal end portion secured to said spinning body and a peripheral end portion secured to said arm; and wherein said arm consists of a bent section of said peripheral end portion.

2. A mechanism for feeding spherical projectiles out of a holding magazine into the intake port of a gun, which comprises: a spinning body rotatably mounted in a lower region of said magazine about a substantially vertical axis; at least one impelling arm projecting outwardly and substantially radially from said body, said arm being positioned, shaped and dimensioned to contact and propel projectiles lying in said region toward said intake port; a motor having an axle coupled to said body; switching means for starting and stopping said motor; and means for regulating said feeding by maintaining an uninterrupted row of projectiles in line toward said intake port;

wherein said means for regulating includes a spiral spring having an internal end portion secured to said spinning body and a peripheral end portion secured to said arm; and wherein said spinning body consists of an axially slotted length of said axle.

3. A mechanism for feeding spherical projectiles out of a holding magazine into the intake port of a gun, which comprises: a spinning body rotatably mounted in a lower region of said magazine about a substantially vertical axis; at least one impelling arm projecting outwardly and substantially radially from said body, said arm being positioned, shaped and dimensioned to contact and propel projectiles lying in said region toward said intake port; a motor having an axle coupled to said body; switching means for starting and stopping said motor; and means for regulating said feeding by maintaining an uninterrupted row of projectiles in line toward said intake port;

wherein said means for regulating includes a spiral spring having an internal end portion secured to said spinning body and a peripheral end portion secured to said arm;

wherein said body includes a first spool having an outer wall mounting said arm, and an inner wall; a second spool coaxially mounted within said first spool and having an inside wall coupled to said axle, and a peripheral wall; and said means for regulating comprises at least one spring anchored at one end to said peripheral wall and at an opposite end to said inner wall; and wherein said means for regulating further comprises two of said springs, each anchored at a 180 degree angle from the other.

4. In a paintball loader wherein a spinning paddlewheel momentarily driven by a motor propels a queue of paintballs toward a duet connected to the ammunition intake port of a gun, an improvement which comprises means for maintaining pressure applied by said paddlewheel against said queue of paintballs when said motor is de-energized;

wherein said means for maintaining pressure includes a resiliently variable linkage between said motor and said paddlewheel; and wherein said paddlewheel comprises a spiral spring having a central end connected to said motor and a peripheral end projecting radially and outwardly to form a paddle.

* * * * *

UNITED STATES PATENT AND TRADEMARK OFFICE

CERTIFICATE OF CORRECTION

PATENT NO. : 7,357,130 B2
APPLICATION NO. : 11/123650
DATED : April 15, 2008
INVENTOR(S) : Lester Broersma It is certified that error appears in the above-identified patent and that said Letters Patent is hereby corrected as shown below:

Signed and Sealed this

Fourth Day of November, 2008

JON W. DUDAS
*Director of the United States Patent and Trademark Office*

UNITED STATES PATENT AND TRADEMARK OFFICE

CERTIFICATE OF CORRECTION

PATENT NO. : 7,357,130 B2
APPLICATION NO. : 11/123650
DATED : April 15, 2008
INVENTOR(S) : Lester Broersma It is certified that error appears in the above-identified patent and that said Letters Patent is hereby corrected as shown below:

Column 4, line 31, "toward a duet connected to the ammunition intake port of a" should read -- toward a duct connected to the ammunition intake port of a --.

This certificate supersedes the Certificate of Correction issued November 4, 2008.

Signed and Sealed this

Ninth Day of December, 2008

JON W. DUDAS
*Director of the United States Patent and Trademark Office*